US010645498B2

(12) United States Patent
Reining

(10) Patent No.: US 10,645,498 B2
(45) Date of Patent: May 5, 2020

(54) ELECTRODYNAMIC ACOUSTIC TRANSDUCER WITH CONDUCTIVE MEMBRANE FOR COIL CONNECTION

(71) Applicants: AAC TECHNOLOGIES PTE. LTD., Singapore (SG); AAC TECHNOLOGIES (NANJING) CO., LTD., Nanjing (CN)

(72) Inventor: Friedrich Reining, Vienna (AT)

(73) Assignees: AAC TECHNOLOGIES PTE. LTD., Singapore (SG); AAC TECHNOLOGIES (NANJING) CO., LTD., Nanjing (CN)

( * ) Notice: Subject to any disclaimer, the term of this patent is extended or adjusted under 35 U.S.C. 154(b) by 0 days.

(21) Appl. No.: 15/978,557

(22) Filed: May 14, 2018

(65) Prior Publication Data

US 2018/0332398 A1 Nov. 15, 2018

(30) Foreign Application Priority Data

May 15, 2017 (AT) ..... A 50411/2017

(51) Int. Cl.
*H04R 9/02* (2006.01)
*H04R 9/04* (2006.01)
*H04R 9/06* (2006.01)

(52) U.S. Cl.
CPC ..... *H04R 9/025* (2013.01); *H04R 9/041* (2013.01); *H04R 9/046* (2013.01); *H04R 9/063* (2013.01); *H04R 9/045* (2013.01)

(58) Field of Classification Search
CPC ..... H04R 2209/041
USPC ..... 381/401, 117, 400
See application file for complete search history.

(56) References Cited

U.S. PATENT DOCUMENTS

2003/0174856 A1 9/2003 Johannsen et al.
2008/0044044 A1* 2/2008 Madaffari ..... H04R 9/025 381/186
2008/0247595 A1* 10/2008 Henry ..... H04R 9/06 381/398

(Continued)

FOREIGN PATENT DOCUMENTS

CN 201947435 U 8/2011
DE 102015201919 A1 8/2016

(Continued)

OTHER PUBLICATIONS

First Office Action for counterpart Austrian Patent Application A50411/2017 dated May 15, 2017.

*Primary Examiner* — Alexander Krzystan

(57) ABSTRACT

An electrodynamic acoustic transducer (1*a* . . . 1*c*) is presented, which comprises a housing (2), a membrane (3), a coil arrangement (6*a* . . . 6*f*) attached to the membrane (3) and a magnet system (9, 10, 11). The coil arrangement (6*a* . . . 6*f*) comprises a plurality of coils (7, 8) each having two terminals (T7, T8, T7*a*, T8*a*, T7*b*, T8*b*, T78) being static in relation to the housing (2). At least one pair of coils (7, 8) has one terminal (T78) in common, whereas the remaining terminals (T7, T8, T7*a*, T8*a*, T7*b*, T8*b*) are individual terminals (T7, T8, T7*a*, T8*a*, T7*b*, T8*b*). Connecting wires (12, 13, 12*a*, 13*a*, 12*b*, 13*b*) connect the coils (7, 8) with the individual terminals (T7, T8, T7*a*, T8*a*, T7*b*, T8*b*), and a conductive layer or path (14*a* . . . 14*g*) attached to the membrane (3) electrically connects the coils (7, 8) with the common terminal (T78).

22 Claims, 4 Drawing Sheets

(56) References Cited

U.S. PATENT DOCUMENTS

| | | | | |
|---|---|---|---|---|
| 2010/0104116 | A1* | 4/2010 | Liou | H04R 19/013 381/191 |
| 2014/0321690 | A1 | 10/2014 | Reining | |
| 2016/0007121 | A1* | 1/2016 | Hung | H04R 9/046 381/401 |
| 2016/0212546 | A1* | 7/2016 | Salvatti | H04R 9/06 |

FOREIGN PATENT DOCUMENTS

| | | | |
|---|---|---|---|
| EP | 1845750 | A1 | 10/2007 |
| EP | 2728902 | A2 | 5/2014 |
| JP | H0738993 | A | 2/1995 |
| JP | 2001326988 | A | 11/2001 |

* cited by examiner

ELECTRODYNAMIC ACOUSTIC TRANSDUCER WITH CONDUCTIVE MEMBRANE FOR COIL CONNECTION

CROSS-REFERENCE TO RELATED APPLICATIONS

This application claims priority to Austrian Patent Application No. A50411/2017, filed on May 15, 2017, which is hereby incorporated by reference in its entirety.

BACKGROUND OF THE INVENTION

The invention relates to an electrodynamic acoustic transducer, which comprises a housing, a membrane and a coil arrangement attached to the membrane, wherein the coil arrangement comprises a plurality of coils each having two terminals being static in relation to the housing. At least one pair of coils is serially connected and has one terminal in common. The remaining terminals are individual terminals. Furthermore, the transducer comprises a magnet system being designed to generate a magnetic field transverse to a longitudinal direction of a wound wire of the coil arrangement. Finally, the transducer comprises connecting wires connecting the coils at connecting points, which are between the connecting wires and the coils, with the terminals.

An electrodynamic acoustic transducer of the kind above generally is known. In this context US 2014/321690 A1 discloses a speaker with two coils stacked above another switched in series. Accordingly, the coils have one terminal in common, and the coil arrangement is connected to three terminals by means of three connecting wires.

A drawback of prior art transducers is that the connecting wires are difficult to handle, in particular if they are very thin as this counts for micro transducers, which for example are built-in into phones and other kind of mobile devices. Accordingly, manufacturing is technically complicated and makes the transducer more expensive. In addition, connecting wires, which can be seen as springs, influence and hinder the movement of the membrane. For example, the membrane does not just move piston-like, but also rocks respectively tumbles, which is caused by undesired but unavoidable asymmetries of the speaker. Usually, the connecting wires are comparably long and often shaped like a loop so as to provide a low spring constant, thus keeping the influence of the connecting wires on the movement of the membrane low. Although said influence may be reduced in the presented way, it does not disappear.

SUMMARY OF THE INVENTION

Accordingly, it is an object of the invention to overcome the drawbacks of the prior art and to provide an improved electrodynamic acoustic transducer. Particularly, the influence of the connecting wires on a movement of the membrane shall be reduced in comparison to prior art transducer designs.

The inventive problem is solved by a transducer as defined in the opening paragraph, wherein a conductive layer or path attached to the membrane electrically connects the coils and the common terminal. Particularly, the conductive layer or path connects a common connecting point between the coils and the common terminal.

In this way, a dedicated connecting wire from a common connecting point between the coils to the common terminal, as it is used in prior art designs, can be omitted. Instead, a conductive layer or path on the membrane is used for this reason. Accordingly, the influence of the connecting wires on a movement of the membrane is reduced in comparison to prior art transducer designs. However, a short piece of wire may be used to connect the common connecting point between the coils with the conductive layer or path. Said wire particularly may be a section of the coil wire of one of the coils or both coils at the common connecting point. Both coils may be electrically connected directly at the conductive layer or path or at a distance of the conductive layer or path. Accordingly, in the latter case, a separate, short piece of wire, a short section of the coil wire of one of the coils or short sections of the coil wires of both coils may connect the common connecting point with the conductive layer or path.

Advantage is taken of the fact that just comparably low currents (e.g. for controlling tasks) flow out of or into the common terminal in usual applications, whereas comparably high currents (e.g. caused by an audio signal) can flow from a first coil to a second coil via the common connecting point arranged on the moving part of the speaker. In particular, the resistance of the conductive layer or path is higher than the real value of the impedance of each of the coils, which the conductive layer or path is connected to. Accordingly, the conductive layer or path can be made comparably thin thus hardly deteriorating the membrane characteristics.

In particular, the conductive layer or path may comprise or consist of a conductive adhesive, glue and/or paint attached to the membrane and/or a metallic foil attached to the membrane. Accordingly, the invention can be applied to existing designs easily by simply attaching the conductive layer or path to an existing membrane.

Generally, mounting the coils to each other may be done by means of an adhesive or glue. The coil arrangement may have the shape of a polygon (e.g. of a rectangle or a square) or may be round (e.g. oval or even circular). Moreover, the coil arrangement may comprise two or more coils. The coils of the coil arrangement can be wound in the same direction or in opposite directions.

Particularly, the coil arrangement can comprise coils (in particular two coils), which are identical in shape and which are mounted to each other head first. Using identical coils allows for manufacturing the coil arrangement in a very economic way.

Further details and advantages of an audio transducer of the disclosed kind will become apparent in the following description and the accompanying drawings.

In an advantageous embodiment of the transducer, the individual connecting points between the connecting wires and the coils and/or the common connecting points are symmetrically arranged on the coil arrangement. In this way, the influence of the connecting wires on the rocking/tumbling movement of the membrane can even be more reduced. Forces acting on the membrane caused by the connecting wires are symmetric and do not cause a rocking/tumbling movement of the membrane. So, the influence of the connecting wires on the rocking/tumbling movement of the membrane is practically zero in this case.

In particular, the individual connecting points between the connecting wires and the coils are and/or the common connecting points symmetrically arranged on the coil arrangement a) seen in a direction perpendicular to a plane encompassed by a wound wire respectively by a wire loop and/or b) with respect to a height extension perpendicular to a plane encompassed by a wound wire respectively by a wire loop.

In case a) the coil arrangement is viewed in the direction of a loop axis respectively in a direction, in which the wound wire appears as a loop or as loops. In this view, the individual connecting points between the connecting wires and the coils and/or the common connecting points are symmetrically arranged around the coil arrangement. This is a first approach of symmetry of the individual/common connecting points.

The "loop axis" is perpendicular to a plane encompassed by the wound wire respectively a wire loop. In other words, the loop axis is the axis, around which the coil has to be rotated to wind the coil.

In case b) the individual/common connecting points are beneficially arranged in the same plane (which is encompassed by the wound wire respectively a wire loop of the coil arrangement) and in particular in the mid of a height extension of the coil arrangement. However, the individual/common connecting points may also be arranged in different planes or at different heights to obtain symmetry. For example, a first pair of two individual/common connecting points may be arranged opposite to each other on a first height or level, whereas a second pair of two individual/common connecting points may be arranged opposite to each other on a second height or level. This case b) is a second approach of symmetry of the individual/common connecting points, which can be used alone or in combination with the first approach (case a) of symmetry.

Beneficially, individual/common connecting points may be arranged in a bonding plane of two coils. In this way, manufacturing the coil arrangement is comparably easy. In case of an even number of coils (e.g. two coils), the individual/common connecting points may be arranged in the mid of a height extension of the coil arrangement. If two identical coils are mounted to each other head first, symmetry with regards to the height extension of the coil arrangement can be obtained easily.

The advantage of a conductive layer or path attached to the membrane electrically connecting the coils and the common terminal turns out to be particularly advantageous in the context of symmetric individual connecting points. This especially counts for cases where an odd/even number of terminals is needed for a polygon-shaped coil with an even/odd number of corners/sides. An illustrative example is a rectangular or square coil arrangement with three terminals. Symmetry can be obtained with two symmetrically arranged connecting wires for two "outer" individual terminals and a conductive layer for the common terminal.

Beneficially, also the individual terminals and/or common terminals are symmetrically arranged around the coil arrangement thus further improving the performance of the transducer by avoiding rocking/tumbling of the membrane. Similar to the individual/common connecting points, also the terminals can be symmetrically arranged a) seen in a direction perpendicular to a plane encompassed by a wound wire respectively by a wire loop and/or b) with respect to a height extension perpendicular to a plane encompassed by a wound wire respectively by a wire loop.

To even further improve the performance of the transducer, the connecting wires may be symmetrically arranged around the coil arrangement and/or may be substantially identical in shape.

In yet another beneficial embodiment of the proposed transducer, multiple connecting wires connect a polygonal coil arrangement at its corners. For example, this embodiment provides perfect symmetry for rectangular coil arrangements. Alternatively or in addition, it is very advantageous, if a connection between the conductive layer or path and the coils respectively a common connection point is arranged in a corner of a polygonal coil arrangement, in particular of a rectangular coil arrangement. In view of polygonal coil designs, the magnet system often comprises a number of separate, rod-shaped magnets (respectively magnets shaped like a cuboid) instead of a single ring-shaped magnet. Accordingly, the magnetic field is concentrated on the longitudinal sides of the polygon and is relatively weak in its corners. That is the reason why an individual connection point and/or a common connection point in the corner has nearly no influence on the performance of the transducer. As said, this particularly counts for a magnet system with rod-shaped magnets, but—of course in an alleviated way—also for ring-shaped magnets. Alternatively, multiple connecting wires may connect the coil arrangement at the center of its longitudinal sides what leads to perfect symmetry as well.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
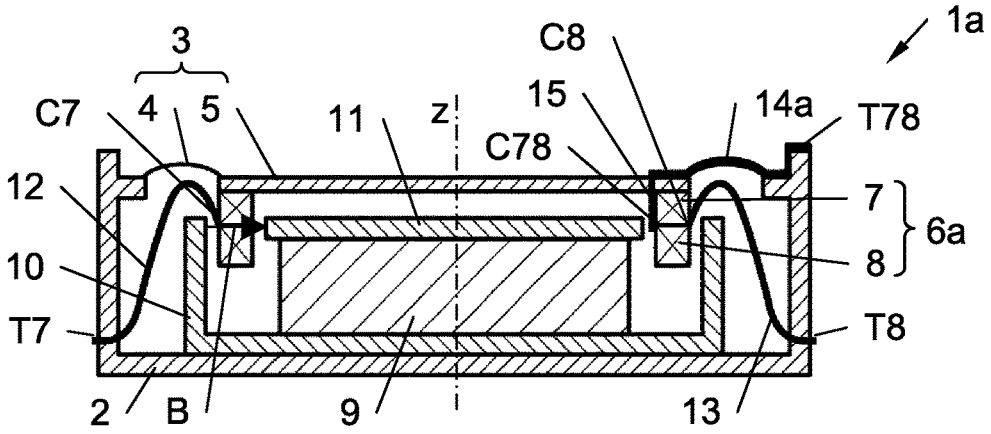
FIG. 1 shows a cross sectional view of an exemplary transducer with a conductive path on the membrane.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about", which particularly means a deviation of ±10% from a reference value.

Figure 2:
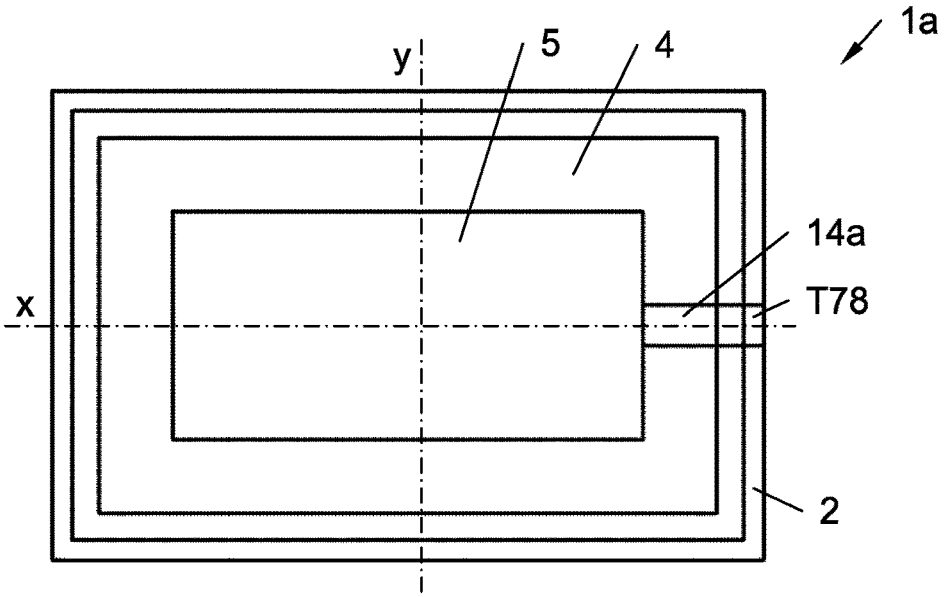
FIG. 2 shows the transducer of FIG. 1 in top view.

FIG. 1 shows an example of an electrodynamic acoustic transducer 1*a*, which may be embodied as a loudspeaker, in cross sectional view. FIG. 2 depicts a top view of the transducer 1*a*. The transducer 1*a* comprises a housing 2 and a membrane 3 with a bending section 4 and a stiffened center section 5. Furthermore, the transducer 1*a* comprises a coil arrangement 6*a* attached to the membrane 3. The coil arrangement 6*a* comprises a first coil 7 and a second coil 8. The first coil 7 is arranged on top of the second coil 8 and concentric to the second coil 8 in this example. Generally, mounting the coils 7, 8 to each other may be done by means of an adhesive or glue.

Furthermore, the transducer 1*a* comprises a magnet system with a magnet 9, a pot plate 10 and a top plate 11. The magnet system generates a magnetic field B transverse to a longitudinal direction of a wound wire of the coil arrangement 6*a*.

The first coil 7 and the second coil 8 are electrically switched in series. Accordingly, the first coil 7 has an individual terminal T7 being static in relation to the housing 2. Similarly, the second coil 8 has an individual terminal T8 being static in relation to the housing 2. A connecting wire 12 connects the terminal T7 and the first coil 7 at an individual connecting point C7, and a connecting wire 13 connects the terminal T8 and the second coil 8 at an individual connecting point C8.

Furthermore, the first coil 7 and the second coil 8 have a common terminal T78. A conductive path 14*a*, which is attached to the membrane 3 and which is electrically connected to the common connecting point C78 of the coils 7, 8, is used for this reason.

Concretely, a short piece of wire 15 connects the common connecting point C78 of the coils 7, 8 and the conductive path 14*a*. On the outer, fixed part of the membrane 3 respectively conductive path 14*a*, the common terminal T78 is arranged. The conductive path 14*a* may comprise or consist of a conductive adhesive, glue and/or paint attached to the membrane 3 and/or a metallic foil attached to the membrane 3.

The common connecting point C78 is arranged directly at the moving coils 7, 8. Beneficially, the connection at the moving coils 7, 8 is made with low ohmic resistance.

Figure 3:
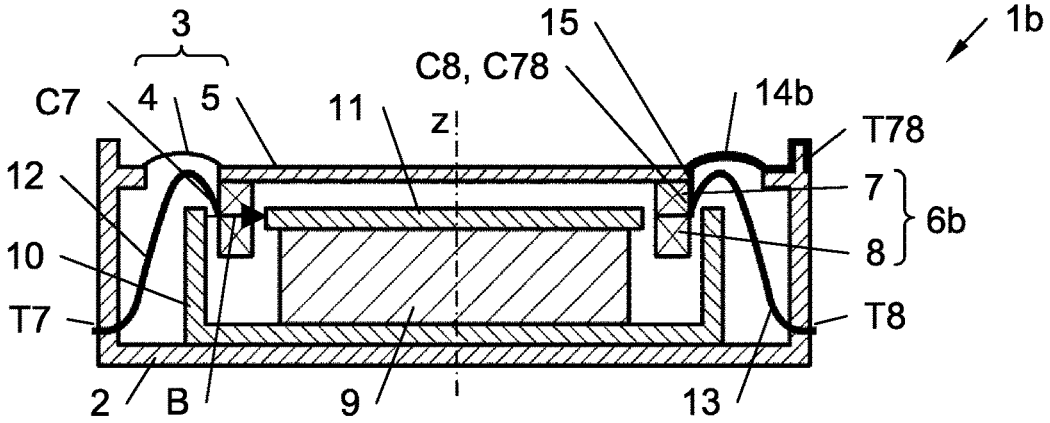
FIG. 3 shows a transducer similar to the transducer of FIGS. 1 and 2, but with a conductive path on the lower side of the membrane.

FIG. 3 shows an alternative embodiment an electrodynamic acoustic transducer 1*b*, which is similar to the transducer 1*a* shown in FIGS. 1 and 2. In contrast, the conductive path 14*b* is not attached to the upper side of the membrane 3, but to the lower side. Additionally, the short piece of wire 15 is arranged on the outer side of the coil arrangement 6*b*, and not on the inner side. Finally, the common terminal T78 is vertically arranged on the circumference of the housing 2.

Figure 4:
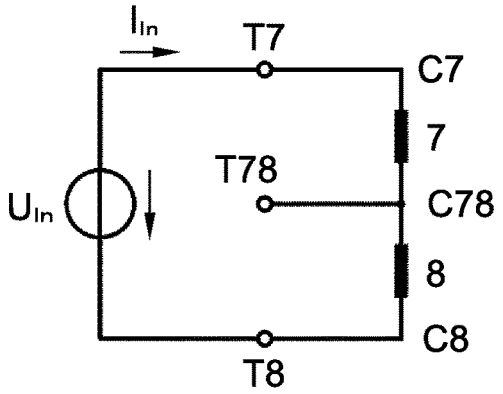
FIG. 4 shows a simplified circuit diagram of the transducer shown in FIGS. 1 and 2.

FIG. 4 shows a simplified circuit diagram of the coil arrangement 6*a* shown in FIGS. 1 and 2. Concretely, FIG. 4 shows a voltage source, generating the voltage $U_{In}$, which is fed to a serial connection of the first coil 7 and the second coil 8. In common designs, the voltage $U_{In}$ forms a sound signal, and a current $I_{In}$ caused by the voltage $U_{In}$, which flows into the terminal T7 and out of the terminal T8 is comparably high. In contrast, currents flowing out of or into the common terminal T78, which are used for controlling tasks for example, are comparably low. One should note that the technical teaching disclosed in the context of FIG. 4 equally applies to the transducer 1*b* shown in FIG. 3.

Figure 5:
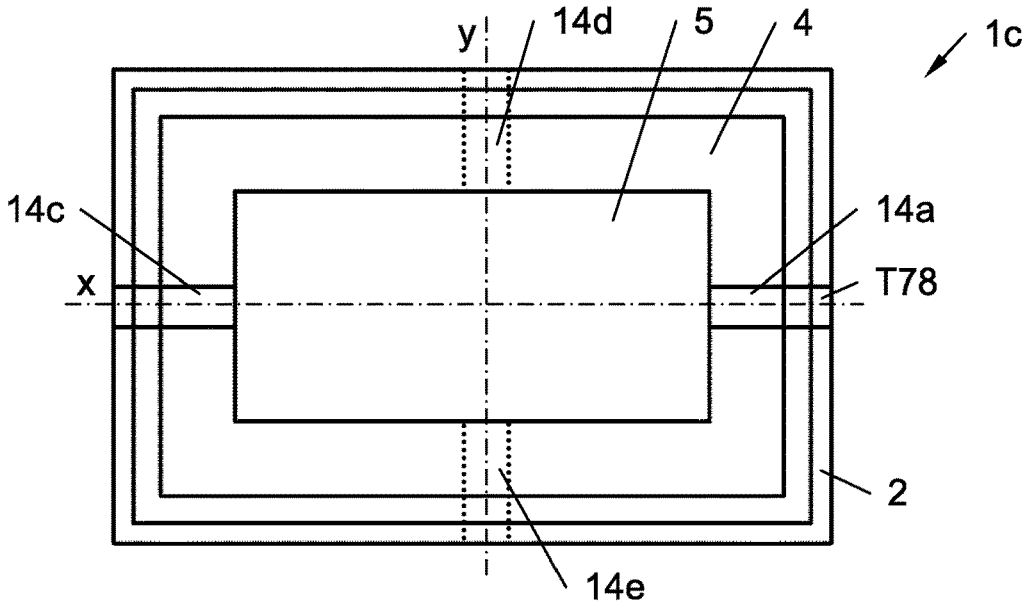
FIG. 5 shows a further example of a transducer in top view with improved symmetry.

By means of the conductive path 14*a*, 14*b* the number of connecting wires and thus their influence on a movement of the membrane 3 can be reduced. The conductive path 14*a*, 14*b* has nearly no influence on a rocking or tumbling tendency of the coil arrangement 6*a*. However, to further improve symmetry, a further conductive path 14*c* may be arranged vis-a-vis of the first conductive path 14*a* or 14*b* as this is shown in FIG. 5. The further conductive path 14*c* may be electrically connected to the coils 7, 8 or not. Another possibility to improve symmetry is to attach a conductive layer to the whole membrane 3 or to attach a conductive layer with symmetric shape to the membrane 3. Further conductive paths 14*d*, 14*e* may be attached to the membrane 3 to connect further common connecting points between coils 7, 8, e.g. if the coil arrangement 6*a* comprises more than two coils 7, 8 switched in series and thus more than one common connecting point C78 and more than one common terminal T78.

Figure 6:
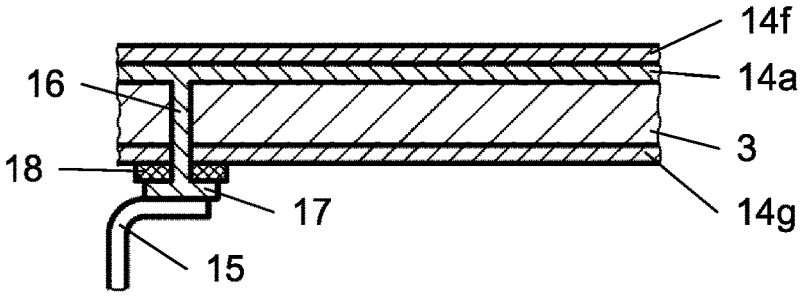
FIG. 6 shows a detailed cross sectional view of an exemplary membrane with conductive paths or layers.

A further possibility to connect more than one common connecting point C78 in case of more than two coils 7, 8 switched in series is to arrange different conductive paths or layers on top of each other and/or on different sides of the membrane 3. In this context, FIG. 6 shows a cut out of an exemplary membrane 3 in cross sectional view (in particular of its bending section 4). Several conductive paths or layers are attached to the membrane 3, concretely a first conductive path or layer 14*a* on the upper side of the membrane 3, a second conductive path or layer 14*f* on top of the first conductive path or layer 14*a* and a third conductive path or layer 14*g* on the lower side of the membrane 3. The layers 14*a*, 14*f*, 14*g* may cover the whole area of the membrane 3 or parts thereof. Of course, the layers 14*a*, 14*f*, 14*g* may differ from each other in size and shape.

FIG. 6 also shows that a layer or path 14*a* on top of the membrane 3 may be connected to a wire 15 by means of a feedthrough or via 16. On the lower side of the membrane 3 there is a contact pad 17, which the wire 15 is connected to. As there is also the third conductive path or layer 14*g* on the lower side of the membrane 3, the contact pad 17 is insulated by means of the insulation 18.

It should be noted that FIGS. 1 to 6 just illustrate the possibilities how to arrange a conductive path or layer 14*a* . . . 14*g* on the membrane 3 and how to contact it with the coil arrangement 6*a* . . . 6*b*. Other embodiments are imaginable without departing from the spirit of the invention. For example, the wires of the coils 7, 8 may directly be led to the contact pad 17 or the conductive path or layer 14*a* . . . 14*g* so as to achieve the serial connection of the coils 7 and 8. In this case, the common connecting point C78 is situated on the connection pad 17 or the conductive path or layer 14*a* . . . 14*g*. Accordingly, the conductive path or layer 14*a* . . . 14*g* (including a via 16 as the case may be) forms the whole connection between the common connecting point C78 and the common terminal T78, whereas in the examples before, a short piece of wire 15 (which generally may be a short section of a coil wire of one of the coils 7, 8 or both coils 7, 8) is part of said connection. In any case, the common connecting point C78 is situated on the moving part of the electrodynamic transducer 1*a* . . . 1*c*. Beneficially, the connection between the coils 7 and 8 via the common connecting point C78 is low-ohmic, whereas the conductive path or layer 14*a* . . . 14*g* may have a higher resistance. Particularly, the resistance of the conductive path or layer 14*a* . . . 14*g* is higher than the real value of the impedance of each of the coils 7, 8, which the conductive path or layer 14*a* . . . 14*g* is connected to. Generally, the common connecting point C78 beneficially is arranged in a corner of a polygonal coil arrangement 6*a* . . . 6*b* (see also FIG. 10).

In the examples hereinbefore, the conductive paths or layers 14*a* . . . 14*g* are attached to the outside of the membrane 3. However, this is not the only possibility. Instead, the conductive paths or layers 14*a* . . . 14*g* may also be arranged within the membrane 3. That means that the membrane 3 may have different layers, wherein some are conductive (e.g. metallic foils) and some are insulating like it is the case in a multilayer circuit board. Especially, if a high number of common connecting points C78 are to be connected, the membrane 3 may have the acoustic function on the one hand, and the function of a circuit board (including vias 16 as the case may be) on the other hand.

Figure 7:
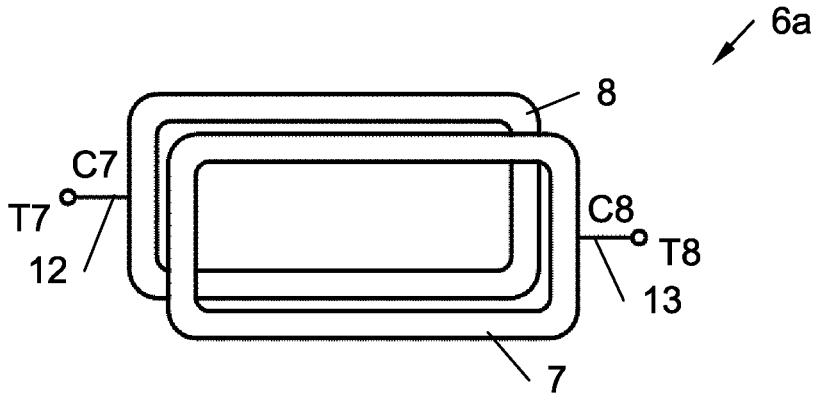
FIG. 7 shows an example of a coil arrangement with the individual connecting points on the short sides of the coils in exploded view.
Figure 8:
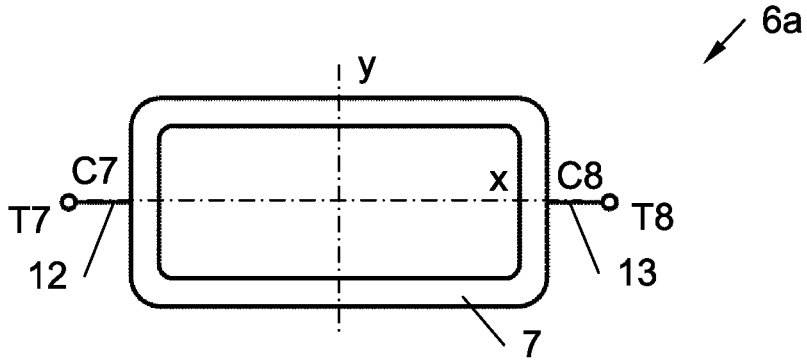
FIG. 8 shows a top view of the coil arrangement of FIG. 7 in operating position.

FIGS. 7 and 8 show a top view of the coil arrangement 6*a*. FIG. 7 shows an exploded view with the coils 7, 8 displaced in diagonal direction, and FIG. 8 shows the coil arrangement 6*a* in operating position with the coils 7, 8 arranged above another.

The individual connecting points C7, C8 are symmetrically arranged around the coil arrangement 6*a*, in particular with respect to the main axes x and y of the rectangular coil arrangement 6*a*.

In a preferred embodiment, also the terminals T7, T8 are symmetrically arranged around the coil arrangement 6*a* as is shown in FIG. 8 (again with respect to the main axes x and y, respectively seen in a direction perpendicular to a plane encompassed by a wound wire respectively by a wire loop—case a). Furthermore, it is advantageous, if also the connecting wires 12, 13 are symmetrically arranged around the coil arrangement 6*a* (again with respect to the main axes x and y) as shown in FIG. 8. Finally, it is also advantageous, if the connecting wires 12, 13 are substantially identical in shape as this is the case in FIG. 8.

Generally, the individual connecting points C7, C8 between the connecting wires 12, 13 and the coils 7, 8 may be symmetrically arranged on the coil arrangement 6*a* seen in the loop axis z respectively in a direction perpendicular to a plane encompassed by a wound wire respectively by a wire loop (case a). In this view, the wound wires of the coils 7, 8 appear as loops. This first approach of symmetry was discussed above.

However, alternatively or in addition a second approach of symmetry of the individual connecting points C7, C8 may be applied to the transducer 1*a*. According to this approach, the individual connecting points C7, C8 between the connecting wires 12, 13 and the coils 7, 8 are symmetrically arranged on the coil arrangement 6*a* with respect to a height extension perpendicular to a plane encompassed by a wound wire respectively by a wire loop (case b). In particular, the individual connecting points C7, C8 may be arranged in the mid of a height extension of the coil arrangement 6*a* as this is the case in FIG. 1. The height extension of the coil arrangement 6*a* is oriented vertically in FIG. 1. However, the individual connecting points C7, C8 may also be arranged on top of the coil arrangement 6*a* or on its bottom.

The individual connecting points C7, C8 beneficially may be arranged in a bonding plane of two coils 7, 8, which is the case in the example shown in FIGS. 1 to 3. In this way, manufacturing the coil arrangement 6*a* is comparably easy.

In a very advantageous embodiment, the coil arrangement 6*a* comprises (two) coils 7, 8, which are identical in shape and which are mounted to each other head first. Using identical coils 7, 8 allows for manufacturing the coil arrangement 6*a* in a very economic way. Because the coils 7, 8 are mounted to each other head first, symmetry with regards to the height extension of the coil arrangement 6*a* is obtained in a very easy way.

Figure 9:
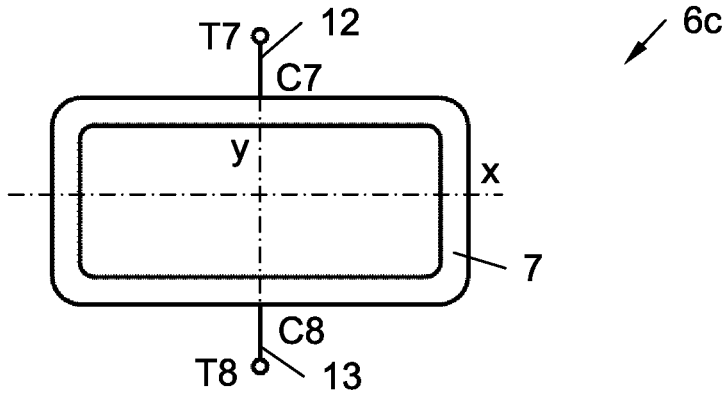
FIG. 9 shows a further example of a coil arrangement with the individual connecting points on the long sides of the rectangular coil arrangement.

FIG. 9 now shows an embodiment of a coil arrangement 6*c*, which is quite similar to the coil arrangement 6*a* shown in FIG. 8. Instead, the individual connecting points C7, C8 are arranged on the y-axis.

In the above examples, symmetry was disclosed with regards the individual connecting points C7, C8. Additionally or alternatively, the technical disclosure related to symmetry of individual connecting points C7, C8 can also applied to the common connecting points C78. Accordingly, symmetry can be obtained for individual connecting points C7, C8 and/or common connecting points C78.

Figure 10:
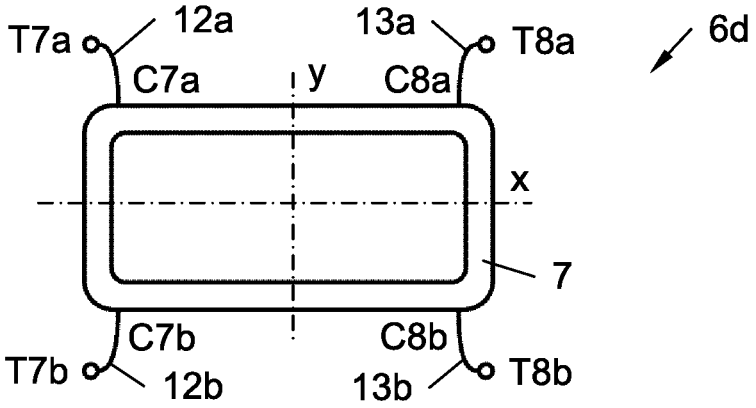
FIG. 10 shows individual connection points in the corners of a rectangular coil arrangement.

FIG. 10 shows a rectangular coil arrangement 6*d* with the individual connection points C7*a*, C7*b*, C8*a* and C8*b* in the corners of the coil arrangement 6*d*. The connection points C7*a* and C8*a* can belong to a first serial connection of the coils 7, 8, whereas the connection points C7*b* and C8*b* can belong to a second serial connection of coils. Accordingly, the individual connection points C7*a*, C7*b*, C8*a* and C8*b* can form the outer taps of two pairs of serially connected coils 7, 8.

In view of polygonal coil designs, often a number of separate, rod-shaped magnets 9 (respectively magnets 9 shaped like a cuboid) instead of a single ring-shaped magnet 9 are used. Accordingly, the magnetic field is concentrated on the longitudinal sides of the polygon and is relatively weak in its corners. That is the reason why an individual connection point C7*a*, C7*b*, C8*a*, C8*b* and/or a common connection point C78 in the corner has nearly no influence on the performance of the transducer 1*a* . . . 1*c*.

Generally, the effect of the magnetic stray field on the wires 12, 13, 12*a*, 13*a*, 12*b*, 13*b* is different than on the conductive paths 14*a* . . . 14*e* because of the different current levels and/or impedances. On the one hand, different current levels lead to different forces acting on the membrane 3 caused by the different currents flowing through the wires 12, 13, 12*a*, 13*a*, 12*b*, 13*b* respectively through the conductive paths 14*a* . . . 14*e*. On the other hand, different voltages are induced into the wires 12, 13, 12*a*, 13*a*, 12*b*, 13*b* respectively into the conductive paths 14*a* . . . 14*e* based on their different impedances. Since the strayfield is lower in the corner regions, as said it is beneficial to use these corner regions for any of the connection types between the coils 7,8 and the non-moving parts of the transducer 1*a* . . . 1*c*, i.e. for the wires 12, 13, 12*a*, 13*a*, 12*b*, 13*b* and/or the conductive paths 14*a* . . . 14*e*. Moreover, it is easier to connect the wires 12, 13, 12*a*, 13*a*, 12*b*, 13*b* respectively the conductive paths 14*a* . . . 14*e* in a region, where no magnets 9 are, for mechanical reasons.

Figure 11:
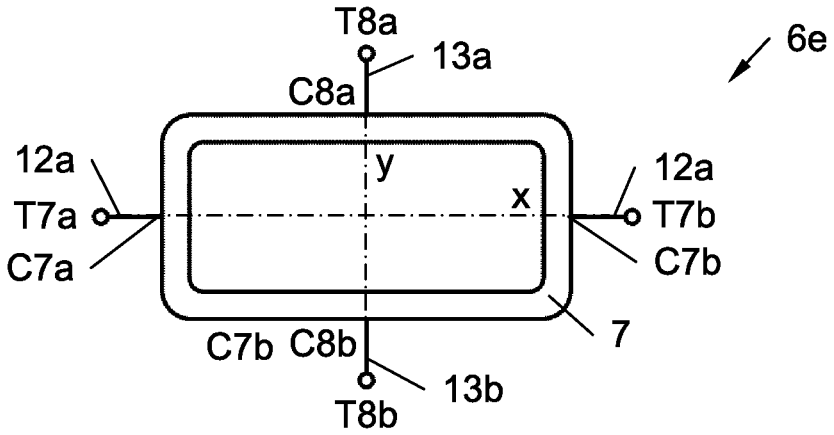
FIG. 11 shows individual connection points at the center of the longitudinal sides of a rectangular coil arrangement and FIG. 12 shows an example of a circular coil arrangement.

FIG. 11 shows a rectangular coil arrangement 6*e*, which is quite similar to the coil arrangement 6*d* shown in FIG. 10. In contrast, the individual connection points C7*a*, C7*b*, C8*a* and C8*b* are not arranged in the corners of the coil arrangement 6*e*, but at the center of its longitudinal sides.

In view of the coil arrangement 6*d* and arrangement 6*e*, conductive paths 14*a* and 14*c* as shown in FIG. 5 may be used for the two common connection points. However, the common connection points C78 and the conductive paths 14*a* . . . 14*e* may also be arranged in the corners of the coil arrangement 6*d*, 6*e*.

Figure 12:
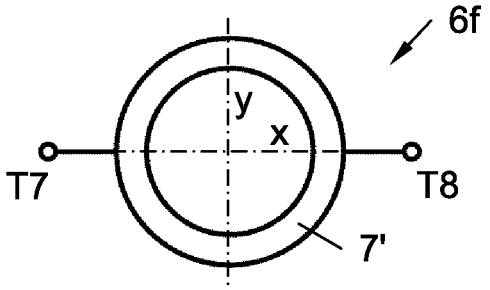

In FIGS. 1 to 11, the coil arrangements 6*a* . . . 6*d* respectively their coils 7, 8 are rectangular in shape. However, this is not the only possibility. A coil arrangement may also be quadratic in shape or round for example. FIG. 12 shows an example of a circular coil arrangement 6*f*. The terminals T7 and T8 are arranged opposite to each other in FIG. 12.

It should be noted that although the examples depicted in the FIGS. 1 to 12 disclose circular and rectangular coil arrangements 6*a* . . . 6*f*, the invention relates to any shape of a coil arrangement 6*a* . . . 6*f*, in particular also to oval and polygonal shapes. Furthermore, the coils 7 and 8 may have the same height or different heights, the same diameter or different diameters as well as the same number of windings or different numbers of windings. Beneficially a coil arrangement 6*a* . . . 6*f* is symmetric with regards to the two main axes x and y.

It should also be noted, that the coils 7, 8 may be wound in the same directions or in opposite directions.

Furthermore, the invention does not just relate to two coils 7, 8, but to any number of coils 7, 8.

Additionally, it should be noted that although symmetric design of individual connecting points C7, C8, C7*a*, C8*a*, C7*b*, C8*b*, common connecting points C78, terminals T7, T8, T7*a*, T8*a*, T7*b*, T8*b*, T78 and connecting wires 12, 13, 12*a*, 13*a*, 12*b*, 13*b* is advantageous, one may also deviate from a strict symmetric design. For example, the terminals T7, T8, T7*a*, T8*a*, T7*b*, T8*b*, T78 may be arranged in a different manner to provide a particular electrical interface. Furthermore, the shape of the connecting wires 12, 13, 12*a*, 13*a*, 12*b*, 13*b* may be different. Nevertheless, the influence of the connecting wires 12, 13, 12*a*, 13*a*, 12*b*, 13*b* on the movement of the membrane 3 may still be substantially symmetric by choosing an adequate design.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

LIST OF REFERENCES

1*a* . . . 1*c* electrodynamic acoustic transducer
2 housing
3 membrane
4 bending section
5 stiffened center section
6*a* . . . 6*f* coil arrangement
7 first coil
8 second coil
9 magnet
10 pot plate
11 top plate
12 . . . 13*b* connecting wire
14*a* . . . 14*g* conductive path
15 wire
16 feedthrough/via
17 contact pad

18 insulation
B magnetic field
C7 . . . C8*b* individual connecting point
C78 common connecting point
T7 . . . T8*b* individual terminal
T78 common terminal
x first main axis
y second main axis
z third main axis/loop axis
$U_{In}$ input voltage
$I_{In}$ input current

What is claimed is:

1. An electrodynamic acoustic transducer, comprising:
a housing;
a membrane;
a coil arrangement attached to the membrane, wherein the coil arrangement comprises a plurality of coils each having two terminals being static in relation to the housing, wherein at least one pair of coils has one terminal in common and wherein the remaining terminals are individual terminals;
a magnet system being designed to generate a magnetic field transverse to a longitudinal direction of a wound wire of the coil arrangement and out of the membrane;
connecting wires connecting the coils at individual connecting points, which are between the connecting wires and the coils, with the individual terminals; and
a conductive layer or path attached to the membrane out of the magnetic field, which conductive layer or path electrically connects the coils and the common terminal; and wherein a wire connects a common connecting point between the coils with the conductive layer or path.

2. The electrodynamic acoustic transducer as claimed in claim 1, wherein the conductive layer or path comprises or consists of a conductive adhesive, glue and/or paint attached to the membrane.

3. The electrodynamic acoustic transducer as claimed in claim 1, wherein the conductive layer or path comprises or consists of a metallic foil attached to the membrane.

4. The electrodynamic acoustic transducer as claimed in claim 1, wherein the resistance of the conductive layer or path is higher than the real value of the impedance of each of the coils, which the conductive layer or path is connected to.

5. The electrodynamic acoustic transducer as claimed in claim 3, wherein a wire connects a common connecting point between the coils with the conductive layer or path.

6. The electrodynamic acoustic transducer as claimed in claim 1, wherein at least two coils of the coil arrangement are wound in opposite directions.

7. The electrodynamic acoustic transducer as claimed in claim 1, wherein the coil arrangement comprises coils, which are identical in shape and which are mounted to each other head first.

8. The electrodynamic acoustic transducer as claimed in claim 1, wherein individual connecting points between the connecting wires and the coils and/or common connecting points are symmetrically arranged on the coil arrangement.

9. The electrodynamic acoustic transducer as claimed in claim 8, wherein individual connecting points between the connecting wires and the coils and/or common connecting points are symmetrically arranged on the coil arrangement:
a) seen in a direction perpendicular to a plane encompassed by a wound wire respectively by a wire loop and/or
b) with respect to a height extension perpendicular to a plane encompassed by a wound wire respectively by a wire loop.

10. The electrodynamic acoustic transducer as claimed in claim 8, wherein the individual terminals and/or common terminals are symmetrically arranged around the coil arrangement.

11. The electrodynamic acoustic transducer as claimed in claim 9, wherein the individual terminals and/or common terminals are symmetrically arranged around the coil arrangement.

12. The electrodynamic acoustic transducer as claimed in claim 8, wherein the connecting wires are symmetrically arranged around the coil arrangement.

13. The electrodynamic acoustic transducer as claimed in claim 12, wherein the connecting wires are substantially identical in shape.

14. The electrodynamic acoustic transducer as claimed in claim 8, wherein connecting points and/or common connecting points are arranged in a bonding plane of two coils.

15. The electrodynamic acoustic transducer as claimed in claim 1, wherein the coil arrangement comprises two coils.

16. The electrodynamic acoustic transducer as claimed in claim 1, wherein the coils are polygonal in shape.

17. The electrodynamic acoustic transducer as claimed in claim 16, wherein a connection between the conductive layer or path and the coils is arranged in a corner of the coil arrangement.

18. The electrodynamic acoustic transducer as claimed in claim 16, wherein multiple connecting wires connect the coil arrangement at its corners.

19. The electrodynamic acoustic transducer as claimed in claim 17 wherein multiple connecting wires connect the coil arrangement at its corners.

20. The electrodynamic acoustic transducer as claimed in claim 16, wherein multiple connecting wires connect the coil arrangement at the center of its longitudinal sides.

21. The electrodynamic acoustic transducer as claimed in claim 17, wherein multiple connecting wires connect the coil arrangement at the center of its longitudinal sides.

22. The electrodynamic acoustic transducer as claimed in claim 1, wherein in that the coils are round, in particular circular, in shape.

* * * * *